US008997541B2

(12) United States Patent
Nillies

(10) Patent No.: US 8,997,541 B2
(45) Date of Patent: Apr. 7, 2015

(54) METHOD AND DEVICE FOR STRETCH-FLOW FORMING

(75) Inventor: Benedikt Nillies, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 505 days.

(21) Appl. No.: 13/377,696

(22) PCT Filed: Jun. 14, 2010

(86) PCT No.: PCT/EP2010/003557

§ 371 (c)(1),
(2), (4) Date: Dec. 12, 2011

(87) PCT Pub. No.: WO2011/003501

PCT Pub. Date: Jan. 13, 2011

(65) Prior Publication Data

US 2012/0090372 A1 Apr. 19, 2012

(30) Foreign Application Priority Data

Jul. 9, 2009 (EP) ..... 09008987

(51) Int. Cl.
*B21D 22/16* (2006.01)
*B23G 9/00* (2006.01)
*B21C 37/26* (2006.01)

(52) U.S. Cl.
CPC ..... *B21D 22/16* (2013.01); *B21C 37/26* (2013.01)

(58) Field of Classification Search
CPC ..... B21D 22/14; B21D 22/16; B21D 22/18; B21C 37/16
USPC ..... 72/80, 82–85, 96, 112, 122, 276, 283, 72/370.01, 370.14, 370.17, 370.18
See application file for complete search history.

(56) References Cited

U.S. PATENT DOCUMENTS 3,874,208 A 4/1975 Werner
3,893,321 A 7/1975 Braunwieser
(Continued)

FOREIGN PATENT DOCUMENTS

CN 1446646 A 10/2003
DE 2230554 1/1974
(Continued)

OTHER PUBLICATIONS

Frank Knecht, PCT Written Opinion, International Application No. PCT/EP2010/003557, International Filing Date Jun. 14, 2010, 5 pages, Untranslated.
(Continued)

*Primary Examiner* — Debra Sullivan
(74) *Attorney, Agent, or Firm* — Hoffman Warnick LLC

(57) ABSTRACT

A method for stretch-flow forming, in which a tubular workpiece is arranged around a spinning mandrel, set into rotation and formed by advancing at least one forming roller. A wall thickness of the tubular workpiece is reduced and the tubular workpiece is lengthened, as spinning mandrel use is made of a universal spinning mandrel with different external diameters in the axial direction for producing cylindrical and/or conical and/or cambered hollow parts of different design. during forming the forming roller and the spinning mandrel are moved relatively in the axial direction with respect to the workpiece, and, for the purpose of designing varying diameters and/or wall thicknesses of the workpiece, the forming roller is moved relatively in the axial direction with respect to the spinning mandrel.

12 Claims, 11 Drawing Sheets

(56) References Cited

U.S. PATENT DOCUMENTS

| | | | | |
|---|---|---|---|---|
| 4,766,752 | A | 8/1988 | Gronert et al. | |
| 6,457,532 | B1 * | 10/2002 | Simpson | 166/380 |
| 7,516,635 | B2 | 4/2009 | Massee | |
| 2003/0019269 | A1 * | 1/2003 | Rolf | 72/85 |
| 2009/0056400 | A1 * | 3/2009 | Dziemballa et al. | 72/100 |

FOREIGN PATENT DOCUMENTS

| | | | |
|---|---|---|---|
| DE | 2230554 | A1 | 1/1974 |
| DE | 3622678 | A1 | 1/1987 |
| DE | 3545506 | A1 | 7/1987 |
| DE | 4307775 | A1 | 9/1994 |
| DE | 10226605 | A1 | 12/2003 |
| DE | 102005057945 | A1 | 6/2007 |
| EP | 0151976 | A2 | 8/1985 |
| EP | 0614712 | A1 | 9/1994 |
| EP | 1348498 | A2 | 1/2003 |
| EP | 2127775 | A1 | 12/2009 |
| GB | 2 178 353 | A | 2/1987 |
| GB | 2184676 | A | 7/1987 |
| JP | 55014107 | A | 1/1980 |
| JP | 2007510546 | A | 4/2007 |
| RU | 2242319 | C2 | 12/2004 |
| SU | 522877 | | 7/1976 |
| SU | 1729661 | | 4/1992 |

OTHER PUBLICATIONS

PCT International Preliminary Report on Patentability and PCT Written Opinion of the International Searching Authority, Dated Jan. 17, 2012, 6 pages.

* cited by examiner

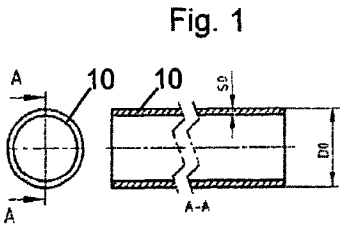
Fig. 1
10
10
A
A
A-A
D0
SP
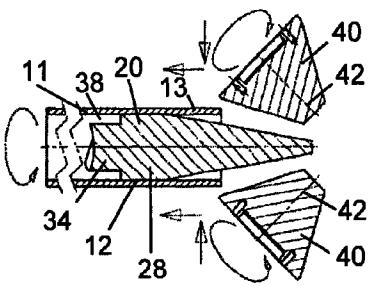
Fig. 2
40
42
42
40
13
20
28
38
12
11
34
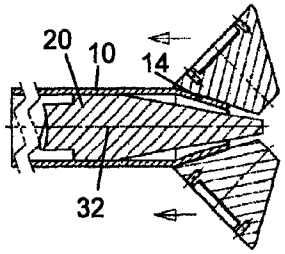
Fig. 3
14
10
20
32
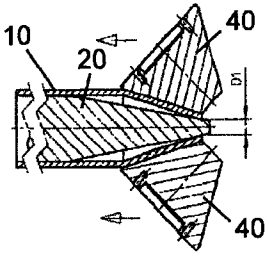
Fig. 4
40
40
D1
20
10
Fig. 5
40
40
10
20
X
D2
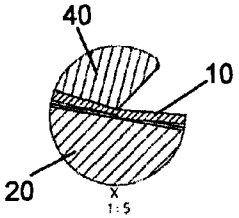
Fig. 6
10
40
20
X
1:5
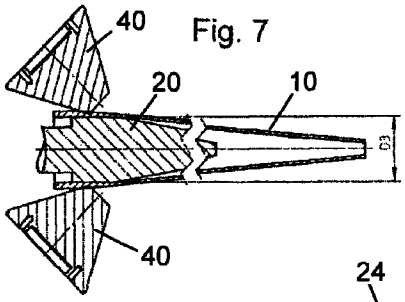
Fig. 7
10
40
20
40
D3
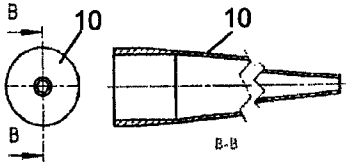
Fig. 8
10
10
B
B
B-B
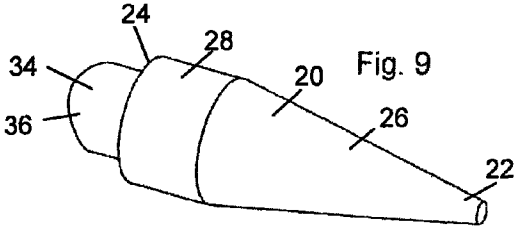
Fig. 9
22
26
20
28
24
34
36

10a
10
15
16
20
20a
21
26
28
40
A-A
B-B

B – B 10
20b
25
28
40
44
46
48
R
60
61
62
63
64
66
67
22
26
27

10
J – J 46
48
40
44
10
20

40
10
20

70
40
20

70
71
40
20
10

70
71
72
40
10

70
71
72

70
71
72
73
74

I – I
75
76
40

H – H
40
75
70
71
72
73
74
75
76
78
79
K - K

K
K 70
72
10
74
76

26
20
28

10
19

40

40
54
10
20
50
20
10

54
40

52
50
56
40

28a
29
26b
28b
34
26a
20

8
10
17
18
20
23
26
28
40
A
B
C

METHOD AND DEVICE FOR STRETCH-FLOW FORMING

FIELD OF THE INVENTION

The invention relates to a method for stretch-flow forming. Furthermore, the invention relates to a device for stretch-flow forming a tubular workpiece.

RELATED ART

In the known method a tubular workpiece is arranged around a spinning mandrel, set into rotation and formed by advancing at least one forming roller, whereby the workpiece is stretched. During stretching the wall thickness is reduced and the tubular workpiece is lengthened as a result of the displaced material.

Such a method is known from DE 43 07 775 A1. In this known method the workpiece can be provided with a uniform inner contour which is predetermined by the outer contour of the spinning mandrel.

The known device has a spinning mandrel which can be arranged in the tubular workpiece, at least one forming roller for advancing towards and forming the workpiece as well as a rotary drive for driving the workpiece in a rotating manner.

In order to form undercuts into a tubular workpiece it is known from DE 102 26 605 A1, for example, that this is accomplished by advancing a roller radially towards a spinning cone. However, this so-called necking-in only proves to be useful at the outer edge of a tube. Moreover, the possible choice of shapes is limited, too.

From DE 2 230 554 A, for example, the use of split spinning mandrels for forming a reduced internal diameter is known. The spinning mandrels have to be produced in a complex and elaborate way for each workpiece shape. In the case of this forming method and devices, the forming of workpieces with a great length necessitates the use of correspondingly long spinning mandrels, which leads to high production and maintenance costs.

From DE 36 22 678 A1 a method and a device for cross rolling seamless tubular blooms is known. In this method, in order to change their wall thickness, provision is made for the tubular blooms to be rolled with a mandrel rod that is displaceable in the axial direction during rolling.

JP 55014107 A describes a forming device for forming a cylindrical workpiece, in which the workpiece is formed between a substantially convex inner tool and a concave outer tool.

GB 2 184 676 A discloses a forming method for forming a cylindrical workpiece by means of forming rollers, which are arranged on the one hand inside and on the other hand outside the cylindrical workpiece. The internal and external forming rollers are arranged opposite each other.

From U.S. Pat. No. 3,874,208 a device for forming a cylindrical workpiece can be taken, in which several forming rollers and a spinning mandrel are moved simultaneously in the longitudinal direction of the workpiece.

DE 10 2005 057 945 A1 describes a flow forming method and a corresponding machine for flow forming a tubular workpiece and in particular for producing a tube section with reduced internal diameter in the shape of a shoulder.

SUMMARY OF THE INVENTION

The invention provides a method and a device, with which tubular workpieces can be flow-formed efficiently and in a large variety of shapes.

In the method according to the invention provision is made that during forming the spinning mandrel is moved relatively in the axial direction with respect to the workpiece.

In the device according to the invention provision is made that during forming the spinning mandrel is supported in a movable manner relatively in the axial direction with respect to the workpiece.

An idea of the invention can be seen in the fact that the workpiece is not, as known to date, formed on a stationary spinning mandrel but on one moving underneath the workpiece. It is therefore sufficient to provide a spinning mandrel with a relatively small length, which can, in particular, be considerably smaller than the length of the workpiece to be processed. As a result, production and maintenance costs for the spinning mandrel are reduced significantly. Consequently, the method according to the invention is especially economical, allowing different workpiece shapes to be produced with one spinning mandrel.

Advantageously, the forming process is implemented by the use of at least two spinning rollers. By preference, the forming rollers are evenly distributed around the circumference of the workpiece and the spinning mandrel, respectively. In this way, undesired transverse forces and therefore deviations of the spinning mandrel can be prevented.

According to the invention it is especially preferred if a universal spinning mandrel with different external diameters in the axial direction is used for producing cylindrical and/or conical hollow parts of different design. The spinning mandrel can also have different contours in the axial direction and, in particular, have a conical design. Non-rotationally symmetrical contours, such as polygons, are possible, too. In this case, the term external diameter is applied accordingly. The variable external diameter and/or the variable contours render it possible for a variable spinning mandrel diameter to be provided during the ongoing forming process on the forming zone, i.e. the contact point between forming roller, workpiece and spinning mandrel.

In an advantageous embodiment of the method provision is made for the method to be carried out in reverse flow, with material of the workpiece flowing in a direction opposed to a feed direction of the forming rollers. During forming the material flows underneath the forming rollers in the direction of a free spinning mandrel end and beyond. Hence, longitudinal feed of the forming rollers and flow direction of the material are opposed to each other. The flow rate of the material is dependent on the reduction of the wall thickness of the workpiece, which is pressed axially by the forming rollers against a clamping or holding means.

In a further advantageous embodiment of the method provision is made for the method to be carried out in forward flow, with material of the workpiece flowing in the feed direction of the forming rollers. Thus, longitudinal feed of the forming rollers and flow direction of the material take place in the same direction. By preference, the basic workpiece for a forming process carried out in forward flow is a blank- or cup-shaped workpiece, which is clamped between the spinning mandrel and a pressing element.

Furthermore, it is particularly advantageous if the forming rollers and the spinning mandrel are moved relatively in the axial direction with respect to the workpiece, and, for the purpose of designing varying diameters and/or wall thicknesses of the workpiece, the forming rollers are moved relatively in the axial and/or radial direction with respect to the spinning mandrel.

As a result of the axial movement of the forming rollers with respect to the tool mandrel the wall thickness or alternatively the internal diameter of the workpiece to be processed can be changed while the external diameter remains constant.

To design varying external diameters and/or wall thicknesses of the workpiece to be processed the forming rollers are preferably moved relatively in the radial direction with respect to the spinning mandrel.

Due to the radial and/or axial displacement of the forming rollers with respect to the spinning mandrel in connection with the variable external diameter and/or the variable contours of the spinning mandrel a variable spinning mandrel diameter can be provided on the whole. This also allows for different wall thicknesses to be produced on the workpiece. The forming rollers are advanced radially towards the spinning mandrel whilst taking the desired external diameter and the desired wall thickness of the workpiece into account.

With the method according to the invention in particular long conical and/or cylindrical hollow parts, as for example preforms for lamp posts or flagpoles, can be produced in an especially economical way. It is possible to form section-wise varying diameters and/or wall thicknesses into the workpieces, which can bring about a reduced weight of the products. Moreover, the cross-sections of the workpiece can be adapted to the expected loads, thereby achieving a particularly even distribution of stress and therefore a particularly favorable utilization of the material employed.

To design a workpiece section with a constant diameter and a constant wall thickness the forming rollers are preferably moved at the same speed as the spinning mandrel with respect to the workpiece. For this purpose the workpiece can e.g. be pushed or pulled through between stationary forming rollers and stationary spinning mandrel. The movement of the workpiece takes place in the direction of a free end of the spinning mandrel which is not clamped. Alternatively, provision can be made for forming rollers and spinning mandrel to be moved with respect to a stationary workpiece. A combination of both variants is possible, too.

Another preferred embodiment of the invention is provided in that the relative movement of the forming rollers in the axial and/or radial direction with respect to the spinning mandrel is controlled by means of a measuring and control means depending on a relative position of the forming rollers with respect to the spinning mandrel and depending on a predetermined gap between forming rollers and spinning mandrel. In other words, the control of the forming rollers and/or the spinning mandrel takes place depending on the desired diameter and the desired wall thickness of the workpiece section to be processed, which are determined by the relative position between forming rollers and spinning mandrel. Furthermore, preferably the length and/or the wall thickness of the workpiece to be processed are measured and these values are processed as input values in the measuring and control means. In this way, uniform end products can be produced even from basic workpieces with dimensional variations.

An especially advantageous embodiment of the method is provided in that the workpiece is clamped on a clamping chuck, which is supported and driven in a rotating manner, and in that the spinning mandrel is moved axially with respect to the clamping chuck. Hence, the workpiece is set into rotation via the clamping chuck. At the same time, a rotation of the spinning mandrel preferably takes place at the same rotational speed, and during forming the spinning mandrel is moved relatively with respect to the clamping chuck in the axial direction. Since only a relative movement between workpiece, spinning mandrel and forming roller is of importance, provision can also be made for the clamping chuck to be moved with respect to a stationary spinning mandrel.

In the case of the device according to the invention it is preferred that the spinning mandrel has different external diameters, in particular having a conical, cylindrical and/or cambered shape. As a result of the different external diameters or alternatively the conical shape a variable spinning mandrel with a variable spinning mandrel diameter is made available. A relative axial feed of the forming rollers with respect to the spinning mandrel and a relative radial advancing of the forming rollers towards the respective diameter of the spinning mandrel takes place in consideration of the desired gap between forming rollers and spinning mandrel. This forming gap determines the wall thickness of the workpiece.

The spinning mandrel can also have other geometrical shapes, for example cylindrical and/or tapered shoulders, radius transitions, profiles such as ribs or grooves, or other cross-sections, such as polygons, hexagons, ellipses. Other geometrical designs are possible, too.

By dispensing with a long, solid mandrel, which is at least as long as the workpiece to be processed, considerable advantages can be achieved. The method according to the invention can be used to advantage for variable workpiece diameters and/or variable wall thicknesses on a workpiece. As a result of the spinning mandrel according to the invention, which can also be referred to as a short-length mandrel, tool costs as well as the costs for maintenance of the spinning mandrel are reduced significantly. In addition, the weight of the spinning mandrel is reduced as compared to a solid mandrel so that the flexibility of the machine is improved considerably.

Another suitable embodiment of the invention resides in the fact that the spinning mandrel has internal rollers at its outer circumference. By preference, at least two supported internal rollers are evenly distributed and arranged in a rotationally fixed manner at the circumference of the spinning mandrel. The internal rollers are rotatable about their own axis but rotationally fixed with respect to a longitudinal axis of the spinning mandrel. By preference, related forming rollers are provided in an approximately corresponding number, which interact with the internal rollers. In this way, rollers pairs are formed that are made up of forming roller and internal roller. Between each of the roller pairs a zone of the plastic material state is generated externally and internally on the workpiece. This results in a division of the roller forces and the forming work. The forming work is distributed to the double amount of rollers. By making use of internal rollers the forming rate can thus be increased. Due to symmetry present in the forming zone a state of internal stress occurring in the flow-formed workpiece is relieved noticeably.

The forming rollers, which can also be referred to as external rollers, can preferably be moved or displaced axially and/or radially. In this way, different forming tasks, as for example different diameters and/or wall thicknesses, can be carried out. Likewise, through axial displacement of the spinning mandrel an adjustment of the gap can be realized.

In flow forming technology the roller diameter is of particular importance. It depends on the wall thickness to be rolled as well as on the workpiece diameter. By preference, internal rollers and external rollers have the same diameter. A difference in diameter of approximately 30% should not be exceeded.

A further preferred embodiment of the device according to the invention resides in the fact that the rotary drive with a clamping chuck for clamping the workpiece and/or a support with at least two forming rollers is axially movable with respect to a machine bed. By moving the rotary drive an axial displacement of the workpiece with respect to the machine bed can be achieved. A constructional design can reside in the fact that the rotary drive is supported on a headstock which is axially movable with respect to the machine bed. Hence, by moving the headstock or alternatively the rotary drive the workpiece clamped via the clamping chuck is moved axially. Additionally or alternatively, the support with the forming rollers can also be moved axially with respect to the machine bed. In this case it is possible to arrange the rotary drive in a fixed manner on the machine bed.

To achieve the relative radial and/or axial advance of the forming rollers provision can be made for the forming rollers to be arranged in a radially and/or axially movable manner on the support. The setting angle in relation to the axis of rotation of the workpiece can be modified, too. The support itself can be arranged in a fixed or displaceable manner on the machine bed. The mounting of the forming rollers on the support with radial and/or axial movability results in a compact construction of the device. The forming rollers can have a suitable shape, for example a cylindrical or conical shape. Likewise, the forming rollers can also have contours for optimal forming.

Another preferred embodiment of the invention is provided in that the spinning mandrel is axially movable with respect to the clamping chuck. It is especially preferred if the spinning mandrel can be driven in a rotating manner together with the clamping chuck and/or the workpiece. This can be achieved e.g. by a spline-groove profile present between spinning mandrel and clamping chuck. Due to the possibility of an axial displacement between spinning mandrel and clamping chuck the relative movement of the spinning mandrel with respect to the workpiece in accordance with the invention is achieved in a simple and reliable manner.

For a reliable forming by means of the device according to the invention it is especially preferred that a measuring and control means is provided for measuring a length and/or a wall thickness and/or a diameter of the workpiece and for controlling a radial movement of the forming rollers and/or a relative axial movement of the forming rollers with respect to the spinning mandrel.

The method according to the invention is, on the whole, based on relative movements between spinning mandrel, workpiece and forming rollers. These elements have to be moved in a coordinated way and depending on the desired forming operation. To this end a measuring and control means is arranged as a device. It measures current geometrical parameters, such as position, length and diameter of the workpiece, and on this basis controls the movement of the said elements in relation to each other.

A particularly economical device is attained in that a feed rod is provided, which is connected to the spinning mandrel and has a diameter which is preferably smaller than the maximum diameter of the spinning mandrel and that an axial drive for movement of the feed rod is provided. Basically, the feed rod can also be arranged in an axially fixed manner, in which case it would then only have the function of an extension or intermediate rod arranged between the spinning mandrel and a mounting or fixing.

One function of the feed rod resides in providing a spacer between the spinning mandrel and its clamping on the machine side. At the beginning of the forming process the workpiece can be arranged around the feed rod. During forming a relative movement between workpiece and spinning mandrel takes place, as a result of which the workpiece moves in the direction of the free end of the spinning mandrel.

The rotation of the spinning mandrel with the feed rod can take place by way of frictional engagement between forming roller, workpiece and spinning mandrel. Between spinning mandrel and feed rod a pressure head can be provided that ensures a rotational decoupling between spinning mandrel and feed rod. In this embodiment only an axial feed is required for the spinning mandrel.

Provision can also be made for the spinning mandrel and/or a variable internal roller to be axially displaceable via a CNC-axis or by way of pressure, e.g. a hydraulic cylinder, in order to achieve a gap adjustment with the spinning mandrel, i.e. a change of wall thickness on the workpiece. So far, this was only possible through radial adjustment of the forming rollers.

The relative movement between workpiece and spinning mandrel can take place by way of an absolute movement of the workpiece with respect to a stationary spinning mandrel and/or an absolute movement of the spinning mandrel. The absolute movement of the spinning mandrel is preferably attained by an axial movement of the feed rod, for which purpose an axial drive is provided.

BRIEF DESCRIPTION OF THE DRAWINGS

In the following the invention is described further by way of preferred embodiments illustrated schematically in the drawings, wherein show:

FIG. 1 a first basic workpiece;

FIGS. 2 to 7 forming steps according to a first embodiment of the method in accordance with the invention as reverse flow forming method;

FIG. 8 a workpiece after forming;

FIG. 9 a first embodiment of a spinning mandrel;

DETAILED DESCRIPTION OF THE INVENTION

Figures 10, 11, 12, 13, 14, 15, 16, 17, 18:
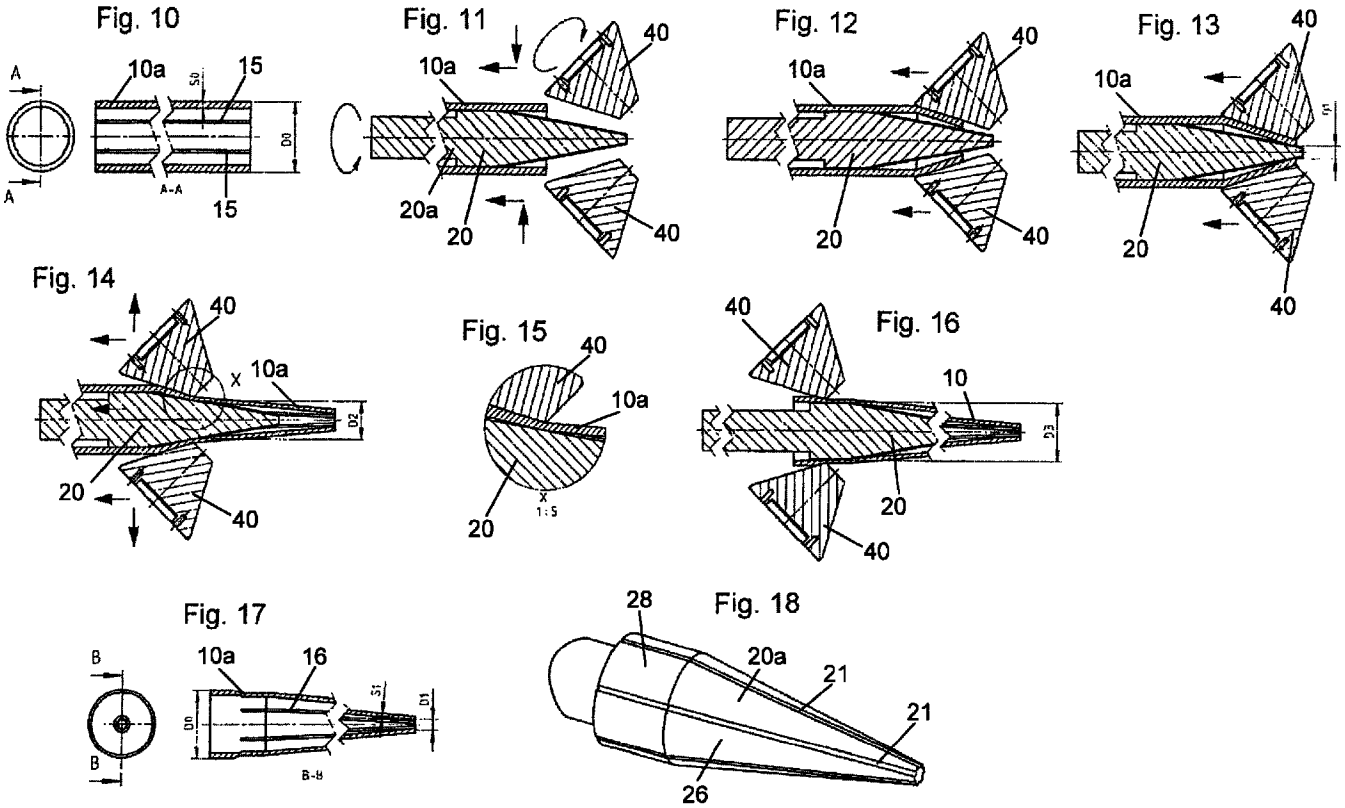
FIG. 10 a second basic workpiece.
FIGS. 11 to 16 forming steps according to a second embodiment of the method in accordance with the invention as reverse flow forming method.
FIG. 17 a second workpiece after forming.
FIG. 18 a second embodiment of a spinning mandrel.

FIGS. 1 to 9 schematically show a first embodiment of the method according to the invention.

FIG. 1 shows a first tubular workpiece 10 which is provided as a basic workpiece for forming. The workpiece 10 has a circular cross-section with an external diameter D0 and a wall thickness S0. FIGS. 2 to 7 show forming steps of forming the workpiece 10 into a conical hollow body illustrated in FIG. 8. For the forming a spinning mandrel 20 is used that is shown in FIG. 9.

The spinning mandrel 20 is a rotationally symmetrical body and has a longitudinal axis. The longitudinal axis constitutes an axis of rotation of the spinning mandrel 20, about which the spinning mandrel 20 is supported in a rotatable manner. On the right side in the Figures the spinning mandrel 20 has a free end 22, whereas on the left side a connecting end 24 is designed, via which the spinning mandrel 20 is connected to a machine clamping and driven where applicable. A fundamental aspect of the spinning mandrel 20 according to the invention resides in the fact that a diameter of the spinning mandrel does not decrease from the free end 22 towards the connecting end 24 but is either constant or increases. The spinning mandrel 20 has a cone section 26 and a cylinder section 28. The cone section 26 is designed as a truncated cone, in which case the end with the smallest diameter constitutes the free end 22 of the spinning mandrel 20.

At the connecting end 24, i.e. the end of the spinning mandrel 20 lying opposite the free end 22, a feed rod 34 is arranged. The feed rod 34 has at least one cylindrical section 36 and is designed as a solid cylinder in the depicted embodiment. By preference, a diameter of the feed rod 34, more particularly of the cylindrical section 36 of the feed rod 34, is smaller than a diameter of the cylinder section 28 of the spinning mandrel 20. The feed rod 34 can be designed integrally with the spinning mandrel 20 or as a separate element it can be connected to the spinning mandrel 20 in a releasable manner. In this way, the spinning mandrel can be changed.

Around the outer circumference of the spinning mandrel 20 several forming rollers 40 are arranged in an evenly distributed manner. FIG. 2 shows two forming rollers 40, while e.g. three or four forming rollers 40 can be arranged, too. The forming rollers 40 are rotationally symmetrical bodies and designed in the shape of a truncated cone in the illustrated embodiment. The forming rollers 40 are rotatably supported about an axis of rotation 42, in which case the axis of rotation 42 is a longitudinal axis of the truncated cone. The axes of rotation 42 of the forming rollers are aligned obliquely to a longitudinal axis 32 of the spinning mandrel 20.

In the forming method in reverse flow described in the following, provision is basically made for the workpiece 10 to be clamped during forming on the headstock side in a non-processed area.

A first method step of forming the workpiece 10 is shown in FIG. 2. Initially, the workpiece 10 is arranged around the spinning mandrel 20 and the feed rod 34. In the depicted method stage a first axial area 11 of the workpiece 10 is arranged around the feed rod 34, with a ring-shaped free space 38 being formed between workpiece 10 and feed rod 34. A second, central axial area 12 of the workpiece 10 is arranged around the cylinder section 28 of the spinning mandrel 20. Here, the workpiece 10 rests against an outer circumferential surface of the cylinder section 28. A third axial area 13 of the workpiece 10 is arranged around a first partial section of the cone section 26 of the spinning mandrel 20.

In the method stage shown in FIG. 2 the forming rollers 40 are axially spaced from the workpiece 10 by being arranged around a second partial section of the cone section 26 of the spinning mandrel 20 and do not contact the workpiece 10.

Spinning mandrel 20 and workpiece 10 are preferably set into rotation at the same circumferential speed. The forming rollers 40 are advanced radially in the direction of the spinning mandrel 20 and moved axially in the direction of the workpiece 10.

In a second method step depicted in FIG. 3 a conical area 14 is formed at the end of the workpiece 10. For this purpose the forming rollers 40 and the spinning mandrel 20 are moved axially at the same axial speed with respect to the workpiece 10. Here, it is only a relative movement that is of importance so that the workpiece 10 can also be moved with respect to spinning mandrel 20 and forming rollers 40. The forming rollers 40 contact an outer circumferential area of the workpiece 10 and are set into rotation by way of frictional engagement with the workpiece 10. Owing to the axial movement of forming rollers 40 and spinning mandrel 20 with respect to the workpiece 10 an axial end area of the workpiece 10 is formed onto an outer circumference of the forming rollers 40 and necked in to form the conical area 14. Initially, the workpiece 10 with its conical area 14 does not contact the spinning mandrel 20 but only the forming rollers 40. During the necking-in process, basically no wall thickness reduction of the workpiece 10 takes place.

At the end of this method step, a method stage is present, in which an axial end of the workpiece 10 rests against the spinning mandrel 20, i.e. by being clamped between spinning mandrel 20 and forming rollers 40. At the axial end the workpiece 10 has an internal diameter D1 which corresponds to an external diameter of the spinning mandrel 20 at this axial position. This method stage is shown in FIG. 4.

With an increasing feed movement of the forming rollers 40 in the axial direction the actual stretch-flow forming process, which can also be referred to as conical flow forming and is shown in FIGS. 5 to 7, commences as the third method step. In the conical flow forming process the workpiece 10 is formed onto the cone section 26 of the spinning mandrel 20, as shown in FIG. 5. During forming a continuous adjustment of the forming rollers 40 in the radial direction takes place. The previously necked-in conical area 14 is stretched as a result of the initiated flow forming operation, and in doing so a reduction of the wall thickness of the workpiece 10 is brought about. At the same time as the axial feeding of the forming rollers 40 takes place, a relative axial displacement of the spinning mandrel 20 occurs with respect to the forming rollers 40. The forming rollers 40 are moved in the direction of an increasing diameter of the spinning mandrel 20 in a relatively axial fashion with respect to the spinning mandrel 20. As a result, an increasing diameter is designed on the workpiece 10.

Due to the direct application of pressure a zone of the plastic material state develops under the forming rollers 40, in which the wall thickness of the workpiece 10 is reduced, as illustrated in FIG. 6. The displaced material mainly flows in the direction of the free end 22 of the spinning mandrel 20, i.e. in a direction opposed to the feed direction of the forming rollers 40. The reduction of wall thickness causes an increase in the length of the workpiece 10.

The forming rollers 40 are moved relatively in the axial direction with respect to the spinning mandrel 20 up to the desired maximum external diameter of the workpiece 10. FIG. 7 shows a method stage, in which the forming rollers 40 have reached the cylinder section 28 of the spinning mandrel 20. Upon a further axial and radial feeding of the forming rollers 40 the contact between forming rollers 40 and workpiece 10 is ceased and the flow forming operation is concluded.

With the illustrated method a workpiece 10 shown in FIG. 8, which is a conical hollow body, is produced. The conical hollow body has the small internal diameter D1 (cf. FIG. 4) at one axial end and a large internal diameter at an opposite end. The small internal diameter D1 corresponds at least to a minimum diameter of the cone section 26 of the spinning mandrel 20. The large diameter is at maximum equal to a diameter of the cylinder section 28 of the spinning mandrel 20. Due to the relative axial displacement of the spinning mandrel 20 with respect to the workpiece 10 the conical hollow body has a different conicity than the cone section 26 of the spinning mandrel 20.

FIGS. 10 to 18 show a second embodiment of the method according to the invention. FIG. 10 shows a second tubular workpiece 10*a* that is provided as a basic workpiece for forming. The workpiece 10*a* has an internal profile that comprises several longitudinal ribs 15 designed on an inner side of the workpiece. With regard to the other dimensions the workpiece 10*a* corresponds to the workpiece 10 depicted in FIG. 1. FIGS. 11 to 16 show forming steps for forming the workpiece 10*a*. FIG. 17 shows the workpiece 10*a* as a finished formed part on completion of forming. In FIG. 18 a spinning mandrel 20 is illustrated which is designed as a profiled spinning mandrel 20*a* and employed in the method.

In contrast to the spinning mandrel 20 depicted in FIG. 9 the profiled spinning mandrel 20*a* according to FIG. 18 has longitudinal grooves 21 at its outer surface. The longitudinal grooves 21 extend both along the cylinder section 28 and along the cone section 26 of the spinning mandrel and at the cylinder section 28 correspond in number and arrangement to the longitudinal ribs 15 of the workpiece 10*a*. At the cone section 26 the longitudinal grooves 21 run conically.

The workpiece 10*a* is slid onto the profiled spinning mandrel 20*a* and formed in analogy to the afore-described method. The method steps illustrated in FIGS. 11 to 17 substantially correspond to the method steps shown in FIGS. 2 to 7. The profile of the spinning mandrel 20 is of larger design according to the volume proportion of the tube profile and on consideration of the diameter reduction resulting from the flow forming process. In FIG. 17 a formed workpiece 10*a* is shown as a final shape of the forming process, which mainly differs from the hollow body depicted in FIG. 8 in that an internal profile is formed at its inner surface that comprises parallel and conically tapering internal ribs 16. The internal profile can therefore be referred to as a cylindrical and conical internal profile. The formed workpiece 10*a* according to FIG. 17 has a wall thickness S1 that is smaller than the wall thickness S0 of the basic workpiece.

Figure 19:
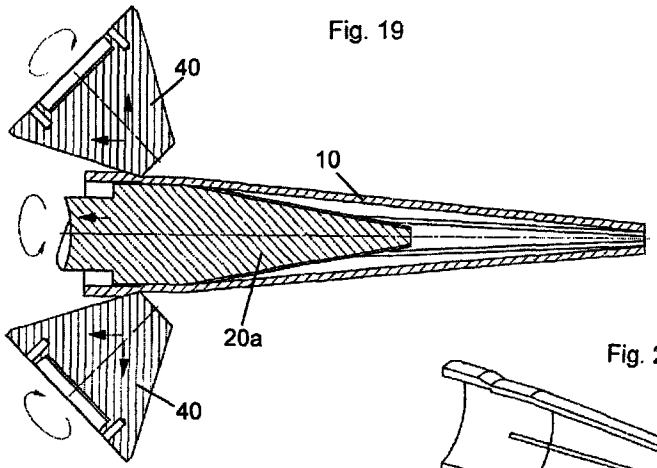
FIG. 19 a forming step according to a third embodiment of the method in accordance with the invention as reverse flow forming method.
Figure 21:
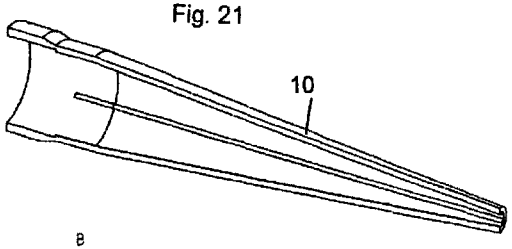
FIGS. 20 to 21 a formed workpiece.
Figure 22:
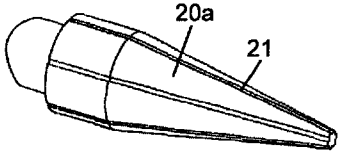
FIG. 22 a third embodiment of a spinning mandrel.
Figure 20:
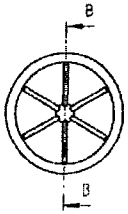
Figure 20:
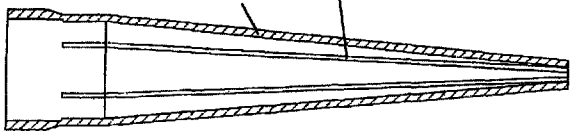

A third embodiment of the method according to the invention is shown in FIGS. 19 to 22. The basic workpiece is a tubular workpiece 10, as illustrated in FIG. 1. FIG. 19 shows a method step of the forming process. The workpiece 10 is shown as a finished formed part in FIG. 20 in perspective view and in FIG. 21 in top view from the front and in cross-section, respectively. FIG. 22 shows a profiled spinning mandrel 20*a* as spinning mandrel 20.

The profiled spinning mandrel 20*a* illustrated in FIG. 22 substantially corresponds to the profiled spinning mandrel 20*a* shown in FIG. 18.

Basically, the forming process takes place in the same manner as described in conjunction with FIGS. 1 to 9. In contrast to this, material of the workpiece 10 is introduced during flow forming into the longitudinal grooves 21 of the profiled spinning mandrel 20*a*. As a consequence of the compressive stress present in the forming zone, i.e. the zone of the plastic material state, material also flows in the radial direction and fills the groove cross-section preferably to completion. At the same time an axial flow of material takes place, especially in those areas of the mandrel that are not provided with grooves. This flow can be fostered by a forming roller geometry that is adapted accordingly to the geometry of the spinning mandrel.

A conical and/or cylindrical internal profile can be produced not only in long hollow parts, as for example masts, but also in short hollow parts, such as gear parts with toothing, as for example clutch disk carriers.

Figures 23, 24, 25, 26, 27, 28, 29:
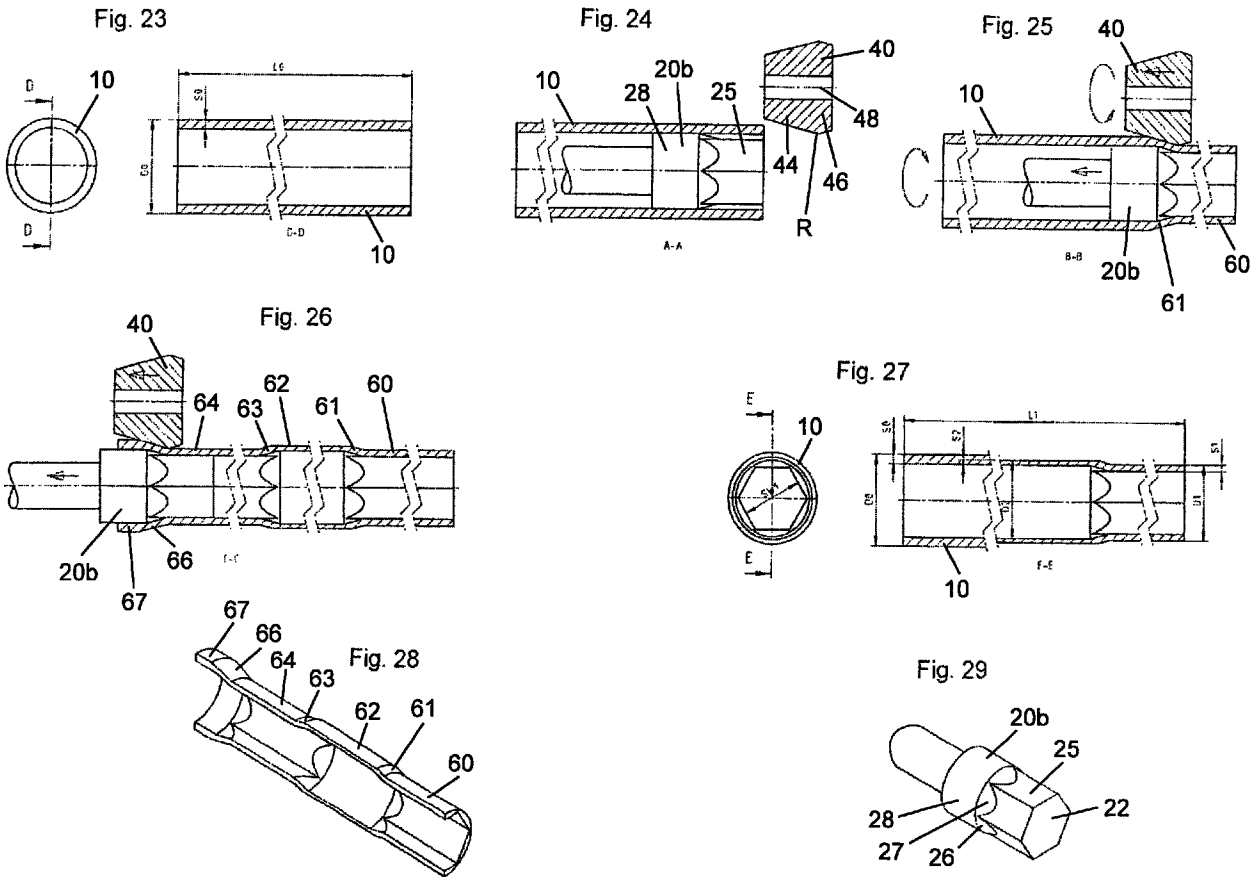
FIG. 23 a further basic workpiece.
FIGS. 24 to 26 forming steps for forming the workpiece shown in FIG. 23 in the reverse flow forming method.
FIGS. 27 to 28 a formed workpiece.
FIG. 29 a further embodiment of a spinning mandrel.

FIGS. 23 to 29 show a fourth embodiment of the method according to the invention. In this method a tubular workpiece 10, as shown in FIG. 23, is formed into a workpiece 10 designed as a hollow shaft or cylinder tube with at least one internal hexagonal area 60 and at least one cylindrical area 62. FIGS. 24 to 27 show method steps for forming the workpiece 10. In FIG. 28 a workpiece 10 is shown as a formed part on completion of processing.

As spinning mandrel 20 use is made of a multi-area spinning mandrel 20*b* as depicted in FIG. 29. This mandrel has a hexagonal section 25, a cylinder section 28 and a cone section 26 arranged in-between. The hexagonal section 25 has a diameter which is smaller than a diameter of the cylinder section 28. The cone section 26 mediates between the hexagonal section 25 and the cylinder section 28 and has at least one inclined surface 27, in which a diameter increases.

The forming rollers 40 used for forming have two conical sections 44, 46 which are opposed to each other. A first conical section 44 defines a run-in angle, while a second conical section 46 defines a smoothing angle. Between the two conical sections 44, 46 the forming radius R is designed. The conical sections 44, 46 have a common longitudinal axis 48 that constitutes an axis of rotation of the respective forming roller 40. In contrast to the previous embodiments the axes of rotation of the forming rollers 40 are aligned parallel to the longitudinal axis 32 of the spinning mandrel.

The tubular workpiece 10 is arranged around the spinning mandrel 20. In a first forming step a first hexagonal area 60 is formed on the workpiece. This area has a cylindrical outer shell surface and a hexagonal inner shell surface. To form the hexagonal area 60 with cylindrical outer shell surface the forming rollers 40 are moved together with the spinning mandrel 20 in the axial direction with respect to the workpiece 10, and in doing so no axial and radial relative movement takes place between forming rollers 40 and spinning mandrel 20. As already set out, the workpiece can also be moved relatively with respect to forming rollers and spinning mandrel.

In a second forming step a conical transitional area 61 is designed in that in the area of the cone section 26 of the spinning mandrel 20 the forming rollers are moved relatively in the axial and radial direction with respect to the spinning mandrel 20.

Afterwards, the workpiece is stretched further in a third forming step, in which a first cylindrical area 62 is formed that has a larger diameter than a diameter of the first hexagonal area 60.

In a fourth method step a second transitional area 63 is formed in which, proceeding from the cylindrical area 62, a diameter of the workpiece 10 decreases. To this end the forming rollers 40 are moved axially relative to the spinning mandrel 20 in the direction of the free end 22 of the spinning mandrel 20 and advanced radially. The forming of the second transitional area 63 therefore takes place in the reverse movement order as compared to the forming of the first transitional area 61.

Afterwards, in a fifth forming step a second hexagonal area 64 is formed through further stretching of the workpiece 10. This area has a smaller diameter than a diameter of the first cylindrical area 62.

Finally, in analogy to the shaping of the first transitional area 61 and the first cylindrical area 62 a terminal area 65 is formed, which comprises a third transitional area 66 and a second cylindrical area 67.

Figures 30, 31, 32, 33, 34, 35, 36, 37:
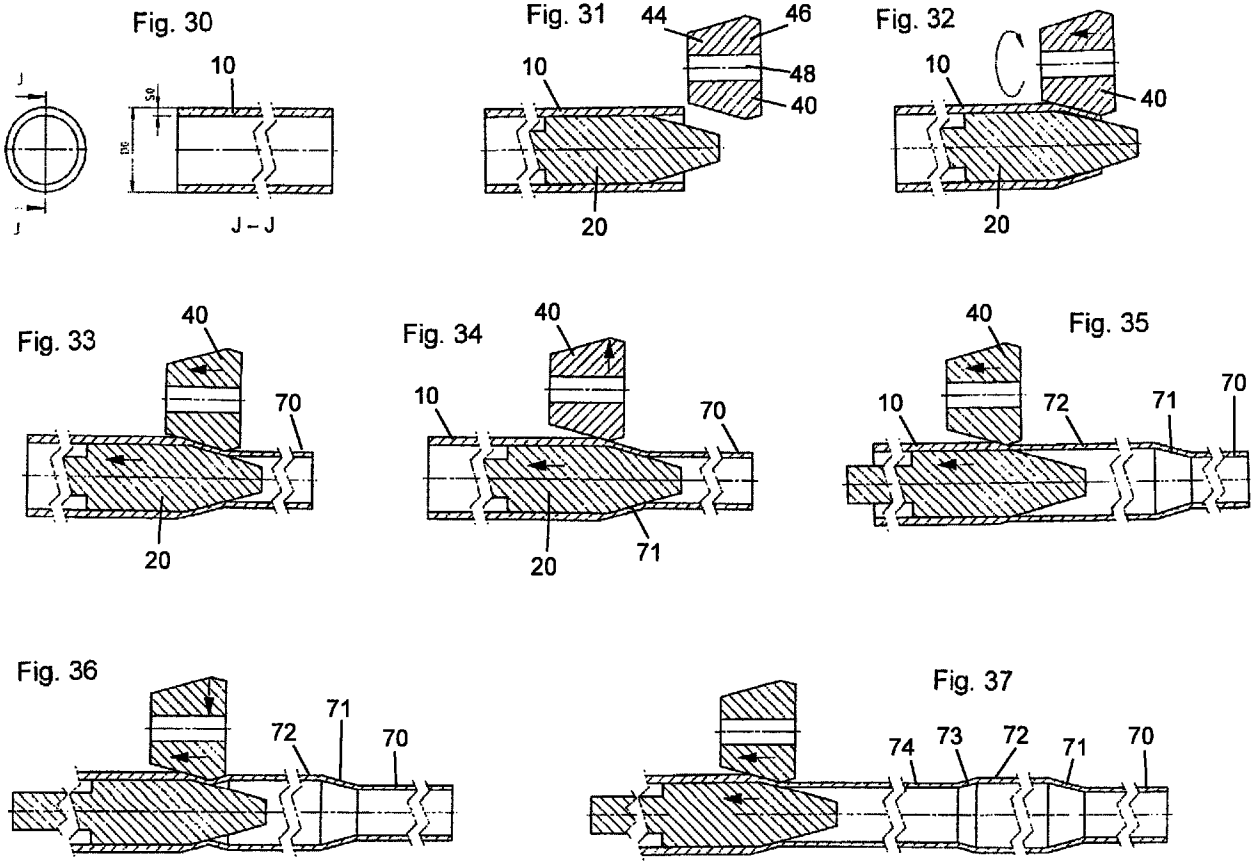
FIG. 30 a further basic workpiece.
FIGS. 31 to 39 forming steps according to a further embodiment of the method in accordance with the invention as reverse flow forming method.

A fifth embodiment of the method according to the invention is illustrated in FIGS. 30 to 43. Here, a tubular workpiece 10 shown in FIG. 30 is formed into a workpiece 10 designed as a cylindrical hollow part with undercut, as shown by way of example in FIG. 40 and FIG. 41. Forming takes place by means of a spinning mandrel 20 shown in FIG. 42. The spinning mandrel 20 corresponds in its basic construction to the spinning mandrel 20 depicted in FIG. 9, while the length ratios of cylinder section 28 and cone section 26 and the conicity of the cone section 26 are modified and adapted to the forming task.

The forming rollers 40 used for forming basically have the same construction as the forming rollers 40 described in conjunction with FIGS. 23 to 29.

The tubular workpiece 10 is arranged around the spinning mandrel 20, FIG. 31. In a first forming step shown in FIG. 32 an end area of the workpiece 10 is necked in through axial movement of the forming rollers 40 with respect to the workpiece 10 and the spinning mandrel 20. Then a first cylindrical area 70 with a diameter D1 and a wall thickness S1 is formed, compare FIG. 40. The diameter D1 is smaller than the diameter D0 of the basic workpiece. Likewise, the wall thickness S1 is smaller than the wall thickness S0 of the basic workpiece. To form the first cylindrical area 70, forming rollers 40 and spinning mandrel 20 are moved axially at the same axial speed relative to the workpiece 10, as shown in FIG. 33.

FIG. 34 shows a second forming step. In this step a conical transitional area 71 is designed in that the forming rollers 20 are moved axially and radially with respect to the spinning mandrel 20 in the area of the cone section 26 of the spinning mandrel 20.

Subsequently, the workpiece 10 is stretched further in a third forming step illustrated in FIG. 35. Here, a second cylindrical area 72 is formed that has a diameter D2 which is larger than the diameter D1 of the first cylindrical area 70.

FIG. 36 shows a fourth method step. In this step a second transitional area 73 is formed, in which, proceeding from the second cylindrical area 72, a diameter of the workpiece 10 decreases. To this end the forming rollers 40 are moved axially relative to the spinning mandrel 20 in the direction of the free end 22 of the spinning mandrel 20 and advanced radially. The forming of the second transitional area 73 therefore takes place in the reverse movement order as compared to the forming of the first transitional area 71.

Afterwards, in a fifth forming step a third cylindrical area 74 with a diameter D3 is formed through further stretching of the workpiece 10. As can be taken from FIG. 40, the diameter D3 is smaller than the diameter D2 of the second cylindrical area 72. This forming step is shown in FIG. 37.

Figures 38, 39, 40, 41, 42, 43:
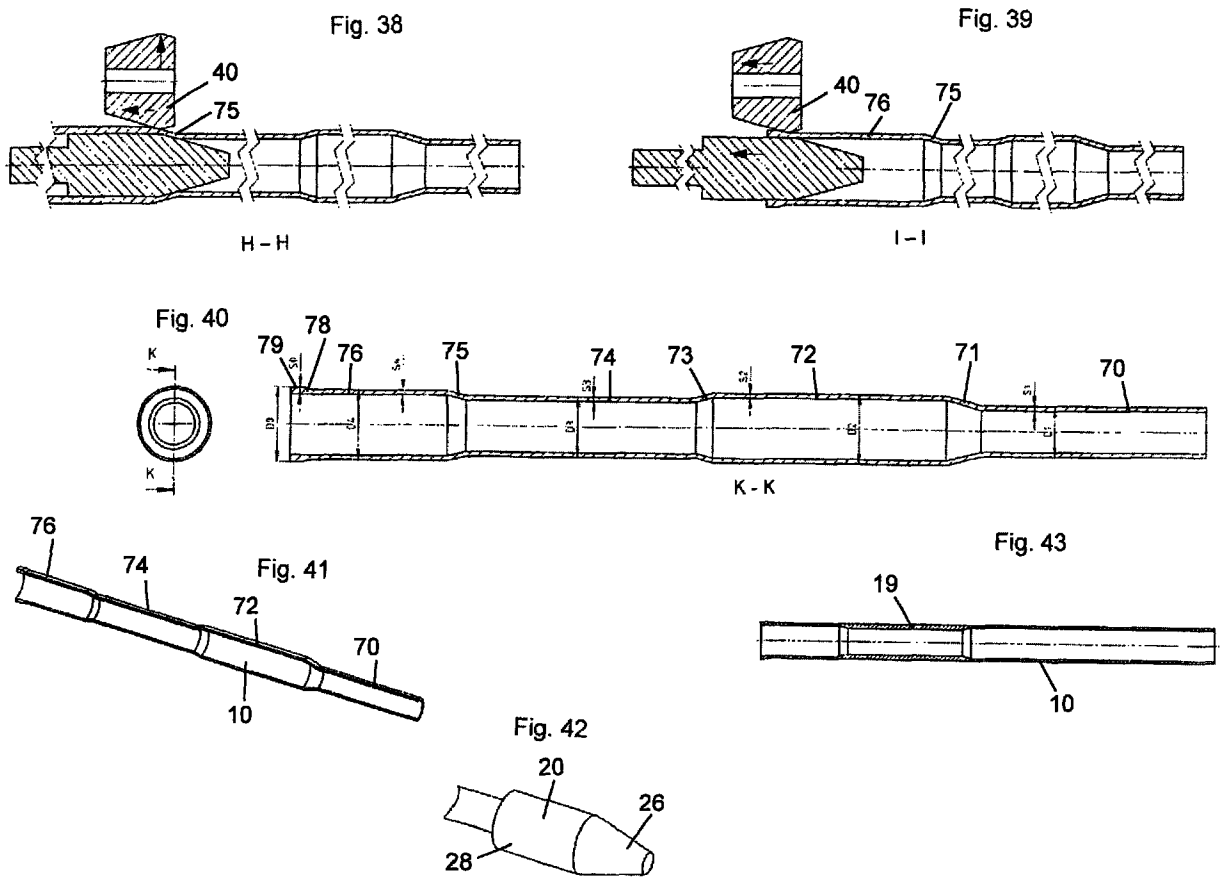
FIGS. 40 to 41 a formed workpiece.
FIG. 42 a further embodiment of a spinning mandrel.
FIG. 43 a further formed workpiece.

FIGS. 38 and 39 show further method steps, in which a third transitional area 75 and a fourth cylindrical area 76 with a diameter D4 are formed in analogy to the first transitional area 71 and the second cylindrical area 72.

Finally, a terminal area 77 is formed which comprises a fourth transitional area 78 and a fifth cylindrical area 79. The fifth cylindrical area 79 has the diameter D0 of the basic workpiece and the wall thickness S0 of the basic workpiece.

With the method it is easily possible to form almost any wall thickness and diameter in an especially economical way. In FIG. 40 a workpiece is shown that has several axial areas with different wall thicknesses S0 to S4, in which case the original wall thickness S0 of the basic workpiece is only present in the terminal area formed last. The workpiece depicted in FIG. 40 is shown in perspective view in FIG. 41.

FIG. 43 shows a further workpiece that has been formed using the method according to the invention. The workpiece has a compensating area 19 designed in a central area of the workpiece. The compensating area can be provided to compensate for dimensional variations of the basic workpiece by shifting excess material into the compensating area 19 or removing therefrom lacking material where appropriate.

The workpiece 10 shown in FIG. 43 has a substantially constant external diameter, whereas in the compensating area 19 an increased wall thickness and therefore a reduced internal diameter is present. With the method according to the invention the workpiece 10 can be produced in a particularly easy and cost-saving way.

FIGS. 44 to 48 illustrate a sixth embodiment of the method according to the invention. Here, a catalyst housing 50 is produced in a single clamping from a rounded, longitudinally welded ring or a seamless tube.

An objective of this method is to adapt a catalyst housing 50 in a precisely fitting manner to the external dimensions of a ceramic carrier body 52. This is based on the finding that the external dimensions of the carrier body 52 vary significantly from production lot to production lot. The result is that carrier bodies 52 with undersize have a loose fit in the housing, while carrier bodies 52 with oversize may cause defects. With the method in accordance with the invention the dimensions of the catalyst housing 50 can be adapted to the carrier body 52, thereby achieving an optimum fit of the carrier body 52 in the catalyst housing 50.

Figures 44, 45, 46, 47, 48:
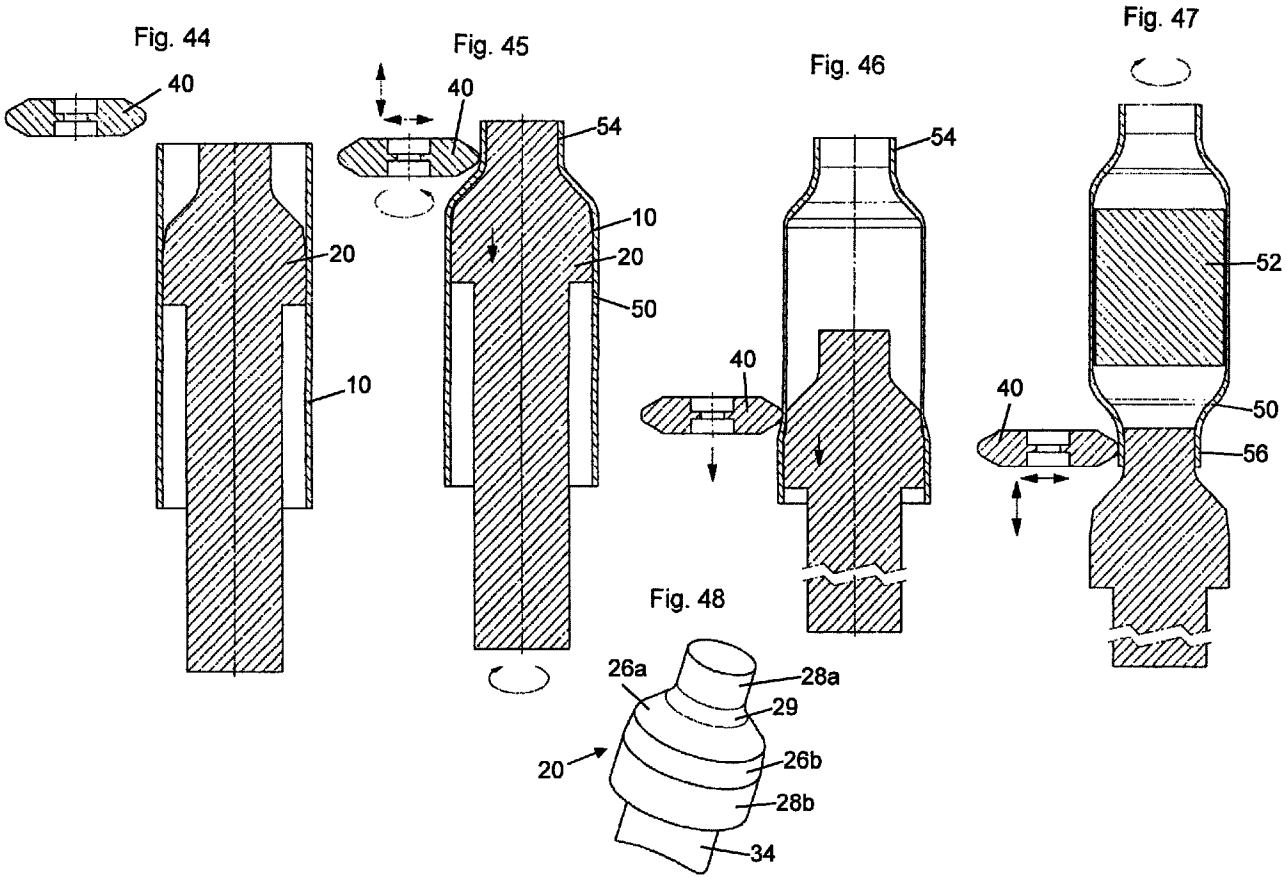
FIGS. 44 to 47 forming steps for producing a catalyst housing.
FIG. 48 a further embodiment of a spinning mandrel.

In the method a spinning mandrel 20 is used, which is shown in FIG. 48. The spinning mandrel 20 has a first cylinder section 28*a* located at an end. Adjacent to this a first cone section 26*a* is designed, with a rounded transitional section 29 being formed between the first cylinder section 28*a* and the first cone section 26*a*. Adjacent to this first cone section 26*a* a second cone section 26*b* is designed that has a smaller conicity than the first cone section 26*a*. In other words, the course of the second cone section 26*b* is flatter than that of the first cone section 26*a*, hence the diameter increases less rapidly per length unit. The second cone section 26*b* is followed by a second cylinder section 28*b* which has a larger diameter than the first cylinder section 28*a*. Finally, adjacent to the second cylinder section 28*b* a feed rod 34 is designed integrally with the spinning mandrel 20, which has a smaller diameter than the second cylinder section 28*b*.

In a first method step illustrated in FIG. 44 the workpiece 10 is arranged around the spinning mandrel 20.

FIG. 45 shows a second method step, in which a first stub 54 of the catalyst housing 50 is formed. In this process, an end area of the workpiece 10 is pressed and/or flow-formed against an outer surface of the spinning mandrel 20.

In a third method step a measuring means measures an external diameter of a carrier body 52 or ceramic inner part to be inserted into the catalyst housing 50. The measured value is transmitted to a control means and, if required, is processed with the previously measured internal diameter and/or the previously measured wall thickness of the workpiece. With the control means a movement of the forming rollers 40, the spinning mandrel 20 and/or the workpiece 10 is controlled. In particular, an internal diameter of the workpiece 10 is regulated or controlled through axial displacement of the forming rollers 40 with respect to the spinning mandrel 20 and in this way the workpiece 10 is stretched in a precisely fitting manner to the desired internal diameter. For an especially sensitive control the second cone section 26*b* is provided that has a low gradient. During forming, a free end of the workpiece 10 can be held in a centering or clamping means.

In a fourth method step the spinning mandrel 20 is removed completely from the workpiece 10 and the carrier body 52 or the ceramic inner part is inserted.

In a fifth method step a second stub 56 of the catalyst housing or a terminal end is formed to a finish.

Figure 49:
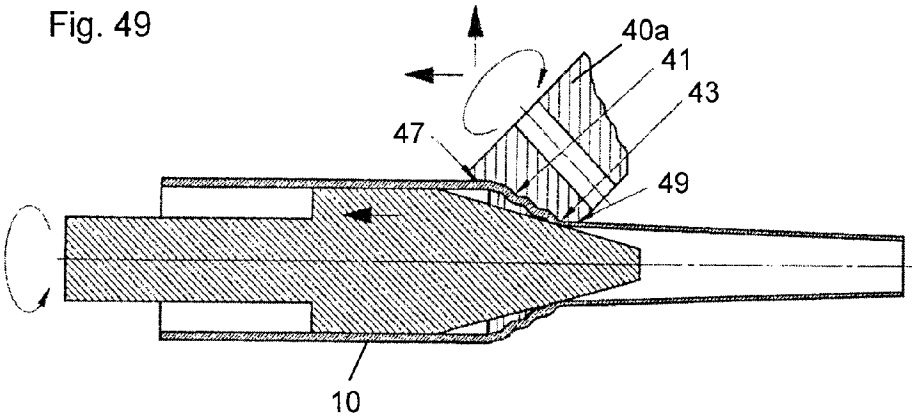
FIG. 49 a forming process by means of a multi-area forming roller.
Figure 50:
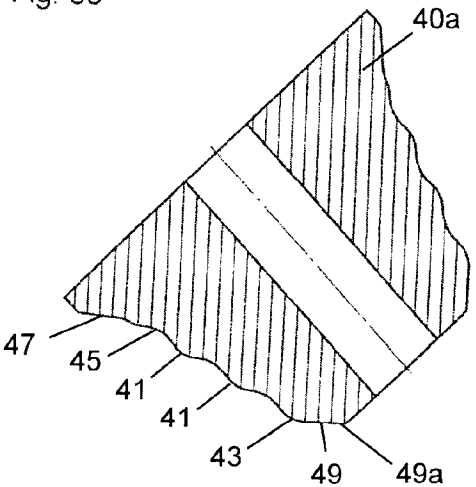
FIG. 50 a multi-area forming roller.

A seventh embodiment of the method according to the invention is depicted in FIGS. 49 and 50. FIG. 49 shows a forming step with a multi-area forming roller 40*a*, which can also be referred to as a multi-area roll. An enlarged view of the multi-area roll is shown in FIG. 50.

With the multi-area forming roller 40*a* or multi-area roll the forming speed during the stretching of cylindrical hollow parts can be increased. The multi-area forming roller 40*a* has a roller profile with at least two forming radii 41 and at least one stretching radius 43. As a result of the at least three radii the workpiece 10 can be formed simultaneously at several positions. Before and behind the forming radii 41*a* wave trough 45 is arranged in each case. The wave troughs 45 serve to reduce a contact surface between multi-area forming roller 40*a* and workpiece 10. In addition, the wave troughs 45 can be used to introduce lubricating and cooling liquid between multi-area forming roller 40*a* and workpiece 10 so as to achieve reduced friction. In the area of the largest diameter of the multi-area forming roller 40*a*, which can be referred to as opening diameter, a hold-down surface 47 is arranged to prevent bead formation on the workpiece 10. Behind the stretching radius 43 a smoothing surface 49 for smoothing the workpiece 10 follows on. The smoothing surface 49 merges into a clearance angle 49*a*.

The absolute values of the radii and work angles depend on the material and have to be determined experimentally.

Figure 51:
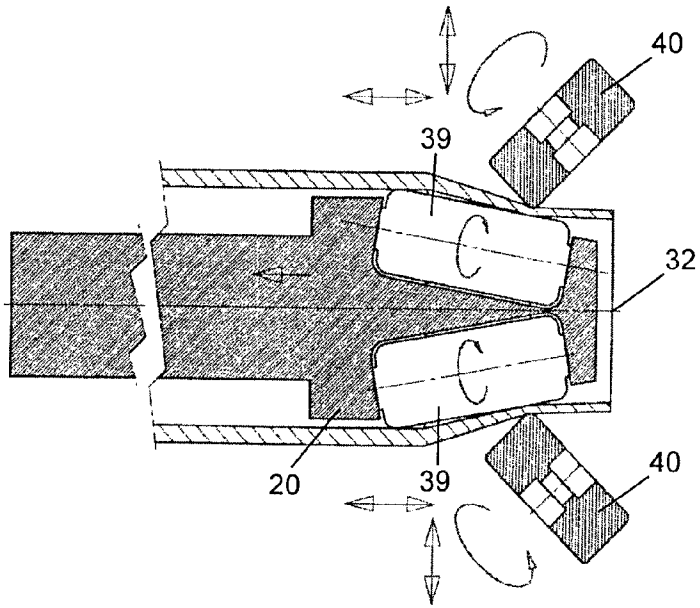
FIG. 51 a forming step by means of a spinning mandrel with internal rollers.

FIG. 51 shows an eighth embodiment of the method according to the invention. Illustrated here is a forming step with a spinning mandrel having two or more internal rollers 39. The internal rollers 39 are evenly distributed around the circumference of the spinning mandrel 20 and supported there in a rotatable manner about an axis of their own. With regard to a longitudinal axis 32 of the spinning mandrel the internal rollers 39 are rotationally fixed. The internal rollers 39 are arranged without axial and radial offset.

The number of internal rollers 39 depends on the internal diameter of the workpiece 10. In FIG. 51 two internal rollers 39 are shown; however, provision can also be made for three, four or more internal rollers 39. The external rollers or forming rollers 40 correspond in terms of number and division to the internal rollers 39, thus acting and forming as a work pair each.

Figures 52, 53, 54, 55, 56, 57, 58:
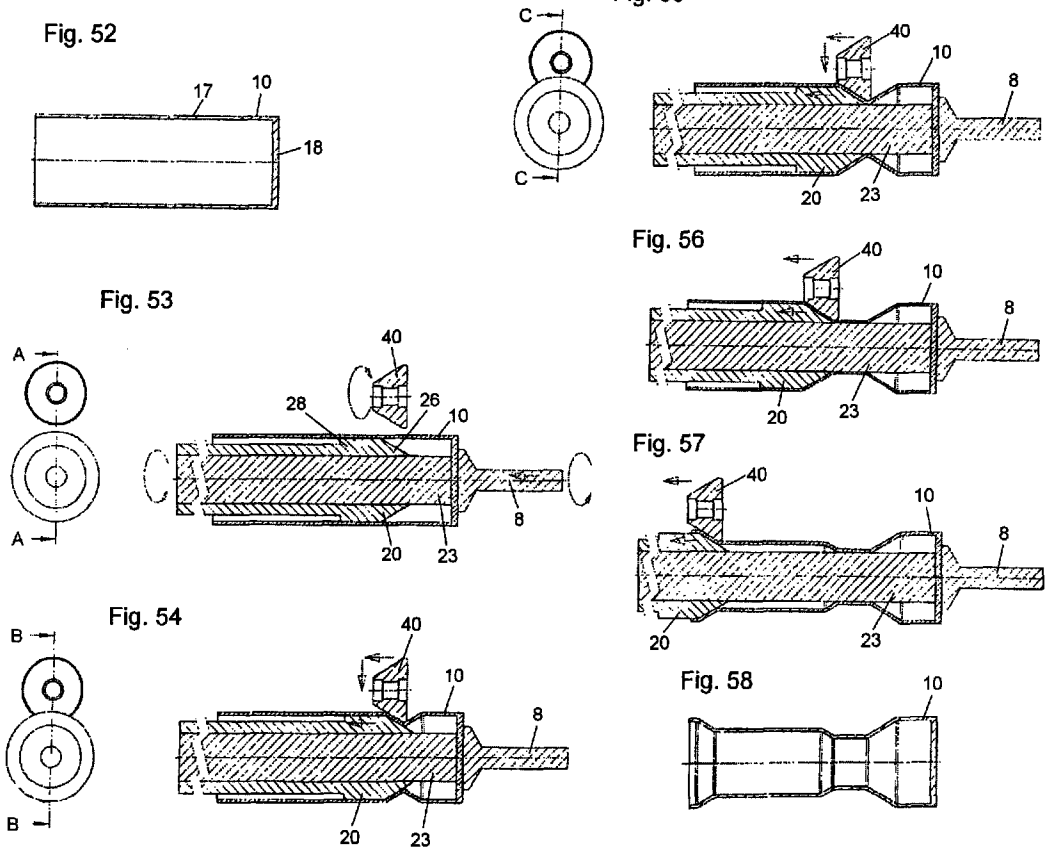
FIG. 52 a cup-shaped basic workpiece.
FIGS. 53 to 57 forming steps according to an embodiment of the method in accordance with the invention as forward flow forming method.
FIG. 58 a formed workpiece.

An eighth embodiment of the method according to the invention is shown in FIGS. 52 to 58. This embodiment is concerned with forming a workpiece in the forward flow forming method. The basic workpiece can be a cylindrical or conical preform. FIG. 52 shows a cup-shaped basic workpiece 10. The workpiece 10 has a cylindrical shell 17 and a bottom area 18.

The spinning mandrel 20 is designed as a hollow mandrel, in which an internal mandrel 23 is arranged. Spinning mandrel 20 and internal mandrel 23 are supported by being axially displaceable in relation to each other.

In FIG. 53 the workpiece 10 is clamped in a rotationally fixed manner between the internal mandrel 23 and a pressing element 8, for example an ejector disk. The cylindrical shell 17 of the workpiece 10 rests loosely on the spinning mandrel 20. In line with the previous embodiments the spinning mandrel 20 has a cone section 26 and a cylinder section 28.

A forming roller 40 is positioned close to the transition of cone section 26 to cylinder section 28. As a first method step, a part of the cylindrical shell 17 of the workpiece 10 is necked in in a controlled way. Due to the direct application of pressure a zone of the plastic material state develops between the forming roller 40 and the spinning mandrel 20, in which the wall thickness is reduced. The displaced material flows in the direction of the axial feed of the forming roller 40. In this process, the forming roller 40 is advanced radially and axially. The spinning mandrel 20 is retracted in the axial direction towards a continuously decreasing diameter.

FIG. 54 shows an intermediate stage of this forming process.

In FIG. 55 the neck-in flow forming operation is concluded. The necked-in workpiece area now rests against the spinning mandrel 20.

In FIG. 56 a further method step is shown, in which the workpiece 10 is stretched cylindrically on the internal mandrel 23 in forward flow forming. In this process, the forming rollers 40 and the spinning mandrel 20 are moved axially. The workpiece 10 is formed between forming rollers 40 and spinning mandrel 20.

From FIG. 57 can be taken that a further portion of the workpiece 10 is stretched in forward flow forming between forming roller 40 and spinning mandrel 20 and that an enlarged opening diameter is formed following on.

A workpiece 10 formed to completion is shown in FIG. 58.

Figure 59:
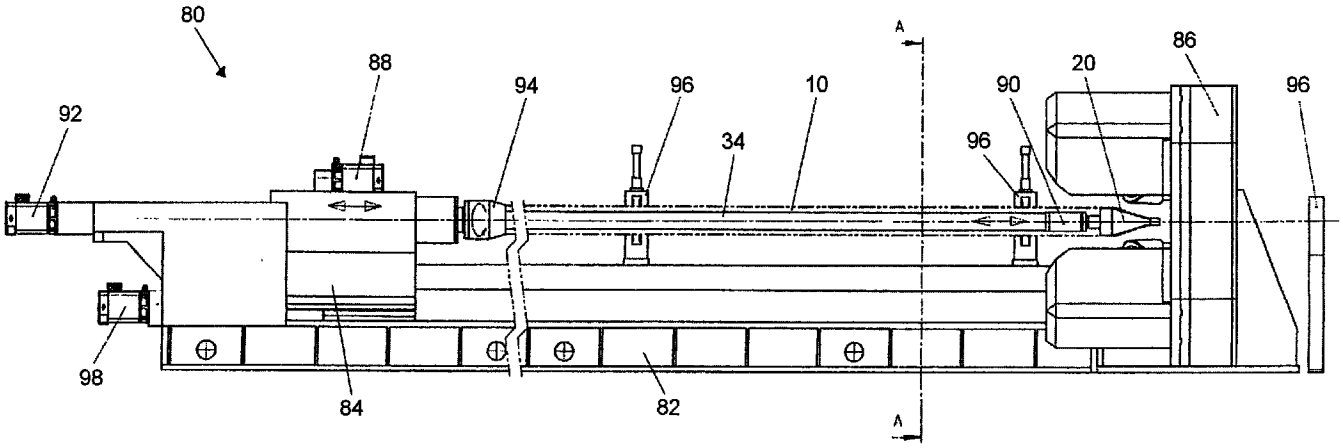
FIG. 59 a side view of a flow forming device.

FIG. 59 shows a device 80 according to the invention for reverse flow forming. The device 80 has a machine bed 82, a headstock 84 and a support 86. The headstock 84 can be displaced axially with respect to the machine bed 82. For axial displacement of the headstock 84 a headstock drive 88 is provided.

On the headstock 84 a spinning mandrel 20 is supported in an axially displaceable manner with respect to the headstock 84 as well as with respect to the machine bed 82. In an axial extension of the spinning mandrel 20 a feed rod 34 is arranged, which is connected to the spinning mandrel 20 via a pressure head 90. The pressure head 90 is arranged between feed rod 34 and spinning mandrel 20 and effects a rotary decoupling between feed rod 34 and spinning mandrel 20. As soon as the forming rollers 40 press the workpiece 10 onto the spinning mandrel 20, the said spinning mandrel 20 is set into rotation by way of frictional engagement between forming roller 40 and workpiece 10. The pressure head 90 prevents co-rotation of the feed rod 34. At the end of the feed rod 34 an axial drive 92 with anti-twist protection is arranged for axial displacement of the spinning mandrel 20 and the feed rod 34, respectively.

On the headstock side the workpiece 10 is clamped by a clamping chuck 94. Between headstock 84 and support 86 as well as behind the support 86 back rests 96 for supporting the workpiece 10 can be arranged. The device 80 furthermore comprises a Z-axis drive 98 for feeding the headstock 84 in the axial direction.

With the device 80 the workpiece 10 clamped on the headstock 84 can be moved axially through axial movement of the headstock 84. This is especially advantageous for processing long workpieces 10, for example for producing lamp posts, and shortens the overall length of the device 80.

Figure 60:
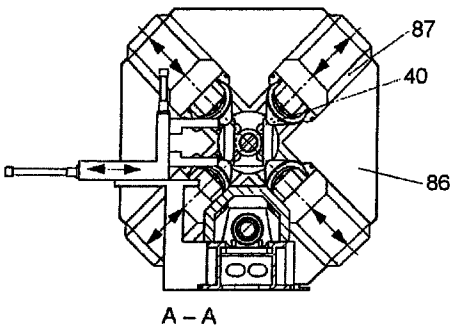
FIG. 60 a cross-sectional view of FIG. 59.

FIG. 60 shows a cross-sectional view of the device 80 depicted in FIG. 52 along the line of intersection A-A. On the support 86 four driven forming rollers 40 are arranged radially along a radial axis 87 each and axially along an axial axis in a relatively movable manner with respect to the spinning mandrel 20 and a main spindle, respectively. The support 86 is firmly connected to the machine bed 82.

Figure 61:
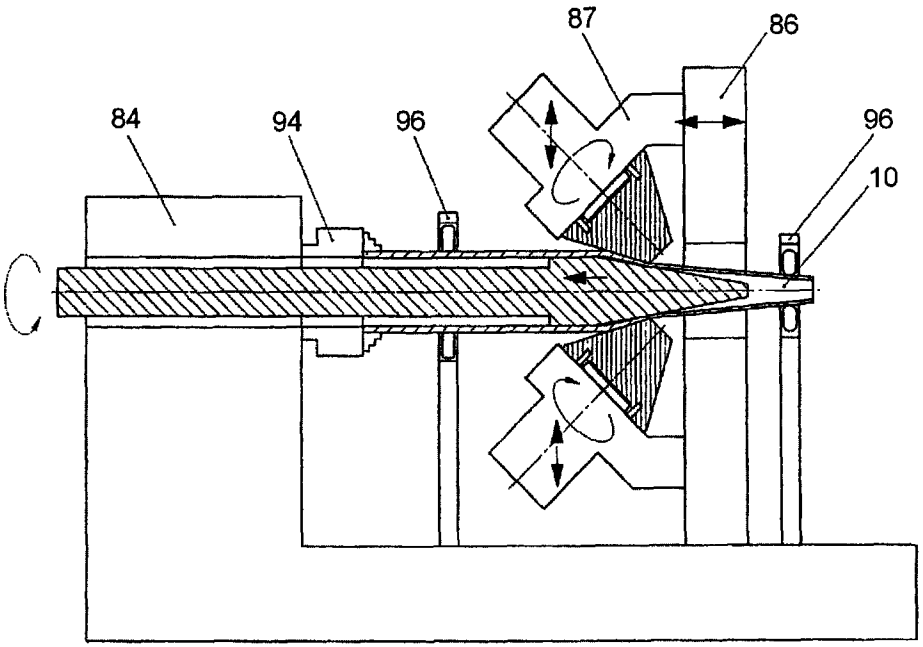
FIG. 61 a second flow forming device.

In FIG. 61 a further device 80 for reverse flow forming is illustrated. In this embodiment the support 86 is arranged in an axially movable manner on the machine bed 82 and the headstock 84 is firmly connected to the machine bed 82. On the support 86, more particularly on a radial axis 87, the forming rollers 40 are supported in a radially movable manner.

Another possibility not depicted here is to provide a tailstock or a holding means behind the support 86.

With the method according to the invention and the device according to the invention tubular workpieces can generally be formed in an especially economical and precise manner.

The invention claimed is:

1. Method for stretch-flow forming, in which a tubular workpiece is arranged around a spinning mandrel with an axis defining an axial direction, and a radial direction perpendicular to the axial direction, set into rotation about the axial direction and formed by advancing at least one forming roller, the method comprising:

clamping the workpiece radially, at one end, on a clamping chuck which is rotatably supported on a headstock and driven in a rotating manner by a rotary drive in the headstock, rotating the tubular workpiece to reduce a wall thickness of the tubular workpiece and lengthen the tubular workpiece, wherein the spinning mandrel includes different external diameters in the axial direction, spinning the spinning mandrel to produce cylindrical and/or conical and/or cambered hollow parts of different design, moving the at least one forming roller and the spinning mandrel relatively in the axial direction with respect to the workpiece during the forming, and, for the purpose of designing varying diameters and/or wall thicknesses of the workpiece, moving the forming roller relatively in the axial and the radial direction with respect to the spinning mandrel, and wherein the spinning mandrel is axially moveably supported on the headstock and moved axially during rotation of the workpiece and forming with respect to the clamping chuck and the headstock.

2. Method according to claim 1, wherein the method is carried out in reverse flow, with material of the workpiece flowing in a direction opposed to a feed direction of the forming roller.

3. Method according to claim 1, wherein the forming roller and the spinning mandrel are moved relatively in the axial direction with respect to the workpiece, and, for the purpose of designing varying diameters and/or wall thicknesses of the workpiece, the forming roller is moved relatively in the axial and radial direction with respect to the spinning mandrel.

4. Method according to claim 1, wherein for forming a workpiece section with a constant diameter and a constant wall thickness the forming is moved at the same speed as the spinning mandrel with respect to the workpiece.

5. Method according to claim 1, wherein the relative movement of the at least one forming roller in the axial and/or radial direction with respect to the spinning mandrel is controlled by means of a measuring and control means depending on a relative position of the forming roller with respect to the spinning mandrel and depending on a predetermined gap between forming and spinning mandrel.

6. Device for stretch-flow forming a tubular workpiece, the device comprising:

a spinning mandrel, which can be arranged in the tubular workpiece, at least one forming roller for advancing towards and forming the workpiece and a rotary drive for driving the workpiece in a rotating manner, wherein the spinning mandrel has different external diameters in the axial direction, during forming the forming roller and the spinning mandrel are supported in a movable manner relatively in the axial and radial direction with respect to the workpiece, and, for the purpose of designing varying diameters and/or wall thicknesses of the workpiece, the forming roller is arranged in a movable manner relatively in the axial direction with respect to the spinning mandrel, a clamping chuck adapted to radially clamp one end of the workpiece and rotatably supported on a headstock the clamping chuck driven in a rotating manner by a rotary drive in the headstock, and the spinning mandrel is axially moveably supported on the headstock and is supported in an axially movable manner with respect to the clamping chuck and the headstock.

7. Device according to claim 6, wherein the spinning mandrel has a conical, cylindrical and/or cambered shape.

8. Device according to claim 6, wherein at its outer circumference the spinning mandrel has at least one internal roller.

9. Device according to claims 6, wherein, the at least one forming roller includes at least two forming rollers, and the rotary drive with the clamping chuck for clamping the workpiece and/or a support having the at least two forming rollers is axially movable with respect to a machine bed.

10. Device according to claim 9, wherein the forming rollers are arranged in a radially and/or axially movable manner on the support.

11. Device according to claim 6, wherein a measuring and control means is provided for measuring a length and/or a wall thickness and/or a diameter of the workpiece and for controlling a radial movement of the forming rollers and/or a relative axial movement of the forming rollers with respect to the spinning mandrel.

12. Device according to claims 6,
wherein
a feed rod is provided, which is connected to the spinning mandrel and has a diameter which is smaller than the maximum diameter of the spinning mandrel, and
in that an axial drive for movement of the feed rod is provided.

* * * * *